US009105418B2

(12) United States Patent
Kagaya

(10) Patent No.: US 9,105,418 B2
(45) Date of Patent: Aug. 11, 2015

(54) ROTARY OPERATION TYPE SWITCH

(71) Applicant: Panasonic Corporation, Osaka (JP)

(72) Inventor: Naritoshi Kagaya, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 247 days.

(21) Appl. No.: 13/899,653

(22) Filed: May 22, 2013

(65) Prior Publication Data

US 2014/0238831 A1 Aug. 28, 2014

(30) Foreign Application Priority Data

Feb. 27, 2013 (JP) ..... 2013-37263

(51) Int. Cl.
*H01H 3/08* (2006.01)
*H01H 19/03* (2006.01)

(52) U.S. Cl.
CPC ..... *H01H 19/03* (2013.01)

(58) Field of Classification Search
CPC ..... H01H 19/46; H01H 19/62; H01H 21/06; H01H 21/18; H01H 3/161; H01H 19/03
USPC ..... 200/336, 11 R, 36, 564, 293
See application file for complete search history.

(56) References Cited

U.S. PATENT DOCUMENTS

| | | | | |
|---|---|---|---|---|
| 4,154,125 | A * | 5/1979 | Frank | 74/553 |
| 4,527,023 | A * | 7/1985 | Ohashi et al. | 200/11 G |
| 6,365,849 | B1 * | 4/2002 | Ono | 200/14 |
| 6,420,667 | B1 * | 7/2002 | Miwa et al. | 200/4 |
| 7,227,090 | B2 * | 6/2007 | Kakuno et al. | 200/6 A |
| 7,439,458 | B2 * | 10/2008 | Montalvo | 200/4 |
| 7,592,562 | B1 * | 9/2009 | Vanderwege et al. | 200/336 |
| 2007/0062788 | A1 * | 3/2007 | Kakuno et al. | 200/6 A |
| 2011/0048912 | A1 * | 3/2011 | Yasuda et al. | 200/5 A |

FOREIGN PATENT DOCUMENTS

JP 8-330108 12/1996

* cited by examiner

*Primary Examiner* — Kyung Lee
(74) *Attorney, Agent, or Firm* — Panasonic Patent Center

(57) ABSTRACT

A rotary operation type switch includes a holder, a rotary control, a shaft, a press-fitting portion, an outer wall part, and a stopper. The holder is provided in a state of immobility in the rotational direction. The rotary control rotates relatively with respect to the holder when a rotational force is imparted. The shaft transmits the rotational force imparted to the rotary control. The press-fitting portion is provided to The rotary control, and an end of the shaft is inserted into it. The outer wall part is provided along a direction perpendicular to the rotational direction of the rotary control. The stopper is provided to the holder, and comes into contact with the outer wall part and restricts the limit position of the rotation range when the rotary control and the shaft rotate relatively with respect to the holder.

7 Claims, 10 Drawing Sheets

ROTARY OPERATION TYPE SWITCH

BACKGROUND

1. Technical Field

The present disclosure relates to a rotary operation type switch that is installed in any of various devices, such as in the remote operation panel of a shoulder-mounted camera, for example.

2. Description of the Related Art

In the past, with a structure in which the operation of a rotating body was transmitted through another structure to a detector switch, a mechanism was employed for fixing a shaft or other such structure whose purpose is to transmit an operation (hereinafter referred to as a transmission structure) on the rotating body side by press fitting.

For example, Patent Literature 1 discloses a volume adjustment knob with which the operation of a rotating body is transmitted directly to a detector switch, and the operating range of the rotating body is limited by the rotating body and a stationary body, without having any transmission structure interposed.

CITATION LIST

Patent Literature

Patent Literature 1: Japanese Laid-Open Patent Application H8-330108

SUMMARY

However, the following problems were encountered with the configuration disclosed in the above-mentioned publication.

Specifically, with this conventional configuration, since the operating range is limited by contact between the rotating body and the stationary body, without having any transmission structure interposed, there is the risk that the rotating body and the stationary body will come into direct contact, damaging one of them.

Meanwhile, with a configuration in which a rotating body is rotated with respect to a stationary body via a shaft or other such transmission structure, if the rotation range is restricted by having the transmission structure come into contact with the stationary body, the press-fitting portion on the rotating body side where the end of the transmission structure is fixed ends up being subjected to a load every time the limit position is reached in the operating range.

This has to be dealt with, for example, by selecting a very stiff material for the rotating body, or increasing the volume of the structure to strengthen the press-fitting portion, so limitations are encountered in terms of price and aesthetics.

It is an object of the present disclosure to provide an inexpensive rotary operation type switch that is sufficiently strong and with which the rotation range can be restricted by a simple configuration, without compromising aesthetics.

The rotary operation type switch disclosed herein comprises a holder, a rotary control, a shaft, a fixing portion, an outer wall part, and a stopper. The holder is provided as a stationary-side member. The rotary control rotates relative to the holder when a rotational force is imparted. The shaft transmits the rotational force imparted to the rotary control. The fixing portion is provided to the rotary control, and a first end of the shaft is inserted into it. The outer wall part forms the outer peripheral face of the fixing portion and is provided in a direction that is perpendicular to the rotational direction of the rotary control. The stopper is provided to the holder and comes into contact with the outer wall part and restricts the limit position of the rotation range when the rotary control and the shaft are rotated relative to the holder.

Effects

With the rotary operation type switch disclosed herein, there is provided an inexpensive rotary operation type switch that is sufficiently strong and with which the rotation range can be restricted by a simple configuration, without compromising aesthetics.

DETAILED DESCRIPTION OF THE PREFERRED EMBODIMENTS

The rotary operation type switch pertaining to an embodiment of the present disclosure will be described through reference to FIGS. 1 to 10*d*.

Remote Operation Panel 100

The rotary operation type switch in this embodiment is installed in a remote operation panel 100 for a shoulder-mounted camera, as a rotary operation type switch component 102*a* of an iris control lever 102.

Figure 1:
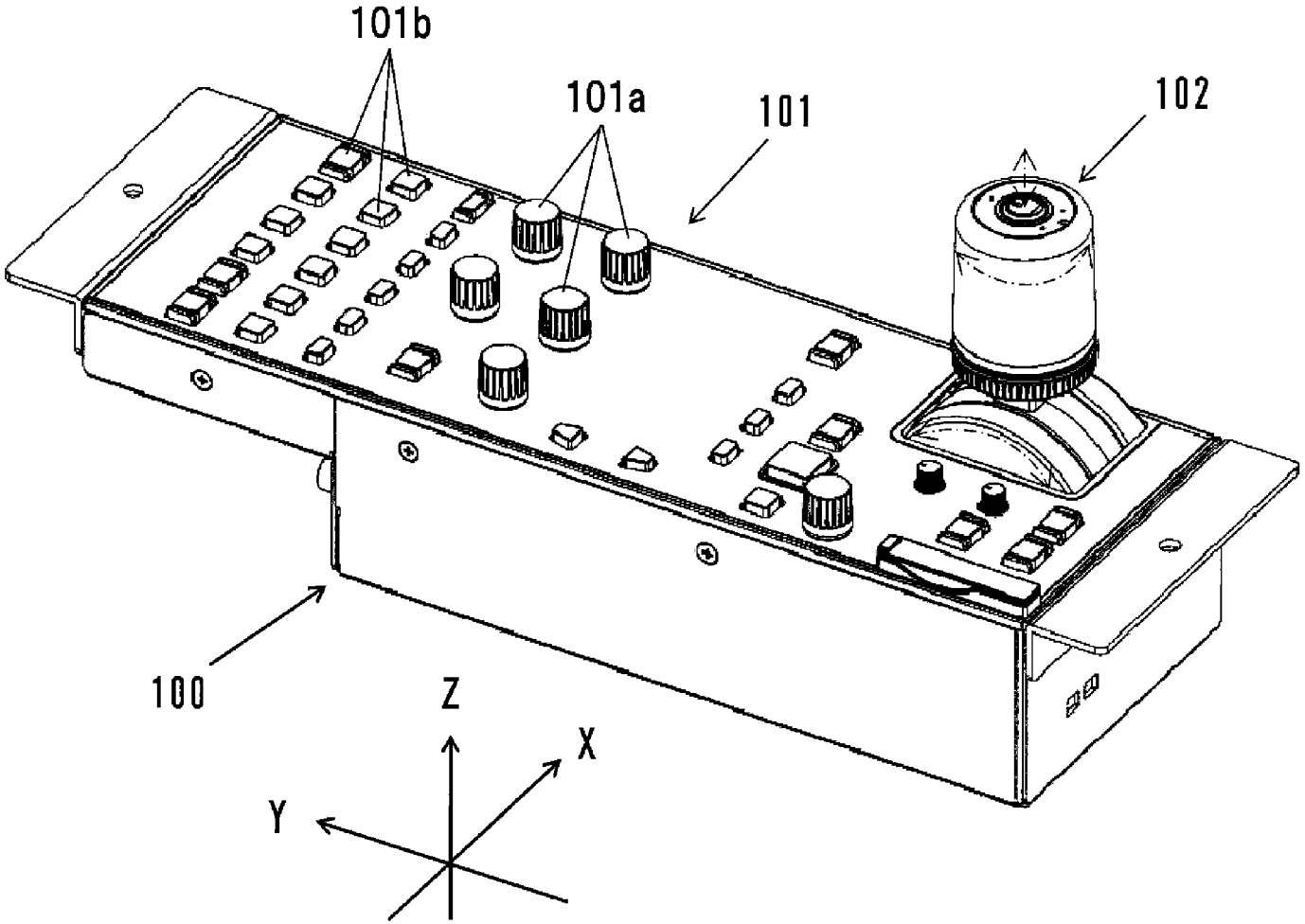
FIG. 1 is an overall oblique view of the configuration of a remote operation panel of a shoulder-mounted camera equipped with the rotary operation type switch pertaining to an embodiment of this disclosure.

As shown in FIG. 1, the remote operation panel 100 comprises a control panel 101 and the iris control lever 102.

As shown in FIG. 1, the control panel 101 has a plurality of image quality adjustment knobs 101*a* and a plurality of image quality adjustment buttons 101*b*, and is used to adjust the image quality of a shoulder camera (not shown).

The iris control lever 102 rotates, pivots, and moves up and down in the three directions indicated by the one-dot chain line in FIG. 1, allowing the user to adjust the lens aperture of the shoulder camera, adjust the black level, switch the preview output on and off, and so forth.

Iris Control Lever 102

Figure 2:
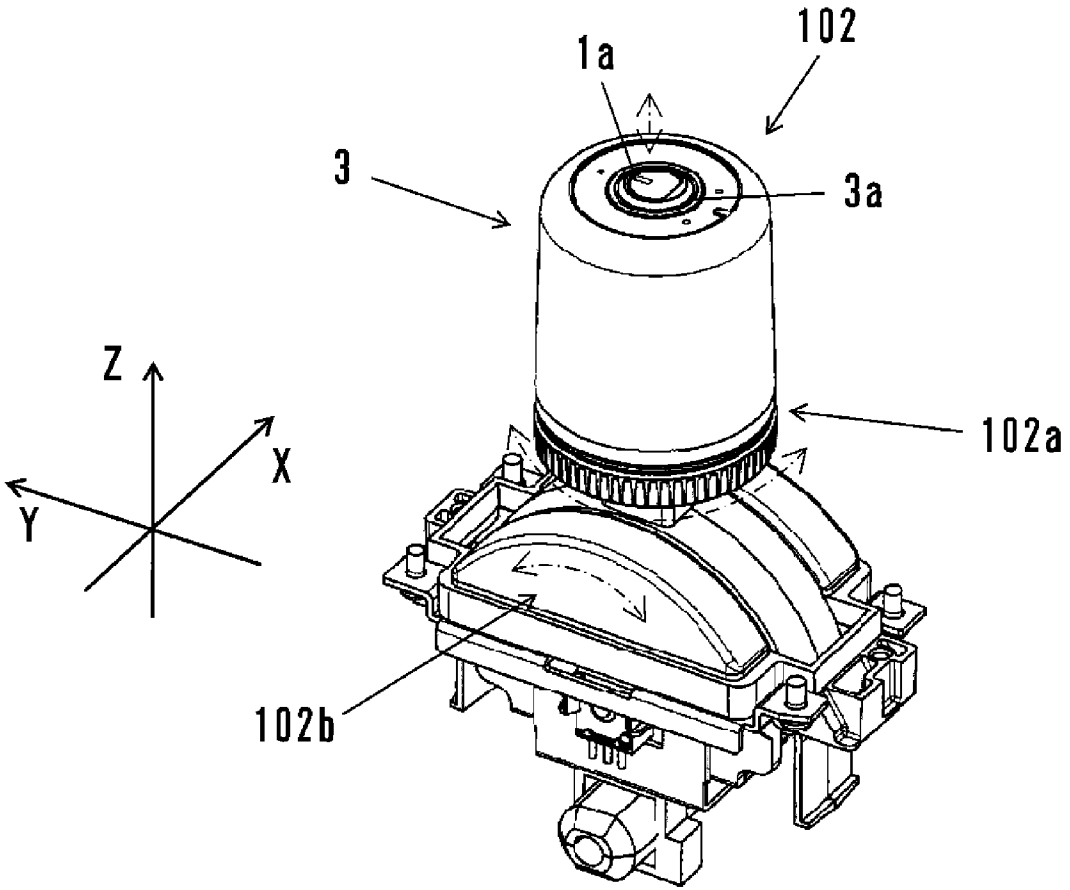
FIG. 2 is an oblique view of the configuration of an iris control lever included in the remote operation panel in FIG. 1.

As shown in FIG. 2, the iris control lever 102 has the rotary operation type switch component (rotary operation type switch) 102*a* and a lever operation type switch component 102*b*.

As shown in FIG. 2, the rotary operation type switch component 102*a* has a substantially cylindrical external shape, and allows various adjustments of the shoulder camera to be made by turning a rotary control 6 (see FIG. 3, etc.) provided so as to protrude from the bottom, or pressing down on the top face portion. The configuration of the rotary operation type switch component 102*a* will be discussed in detail at a later point.

As shown in FIG. 2, the lever operation type switch component 102*b* allows various adjustments of the shoulder camera to be made by pivoting a substantially cylindrical case 3 portion in the Y direction the drawing.

Rotary Operation Type Switch Component 102*a*

Figure 3:
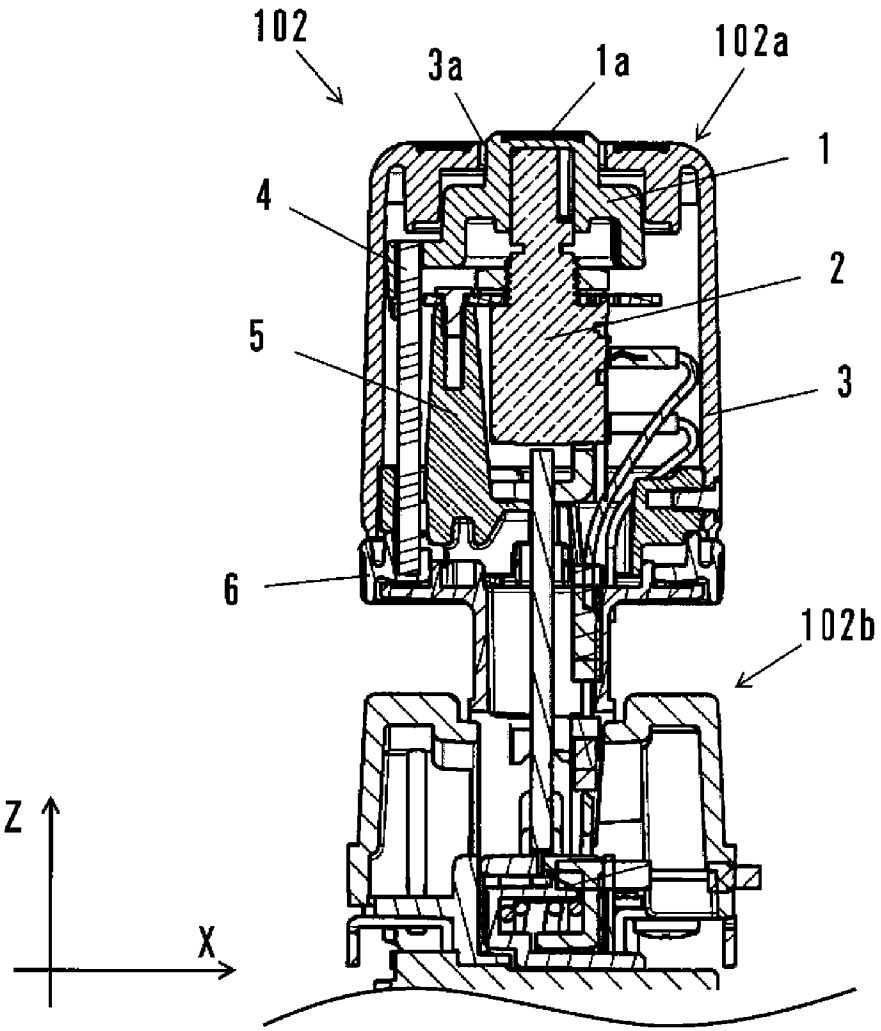
FIG. 3 is a cross section of the internal configuration of the iris control lever in FIG. 2.
Figure 4:
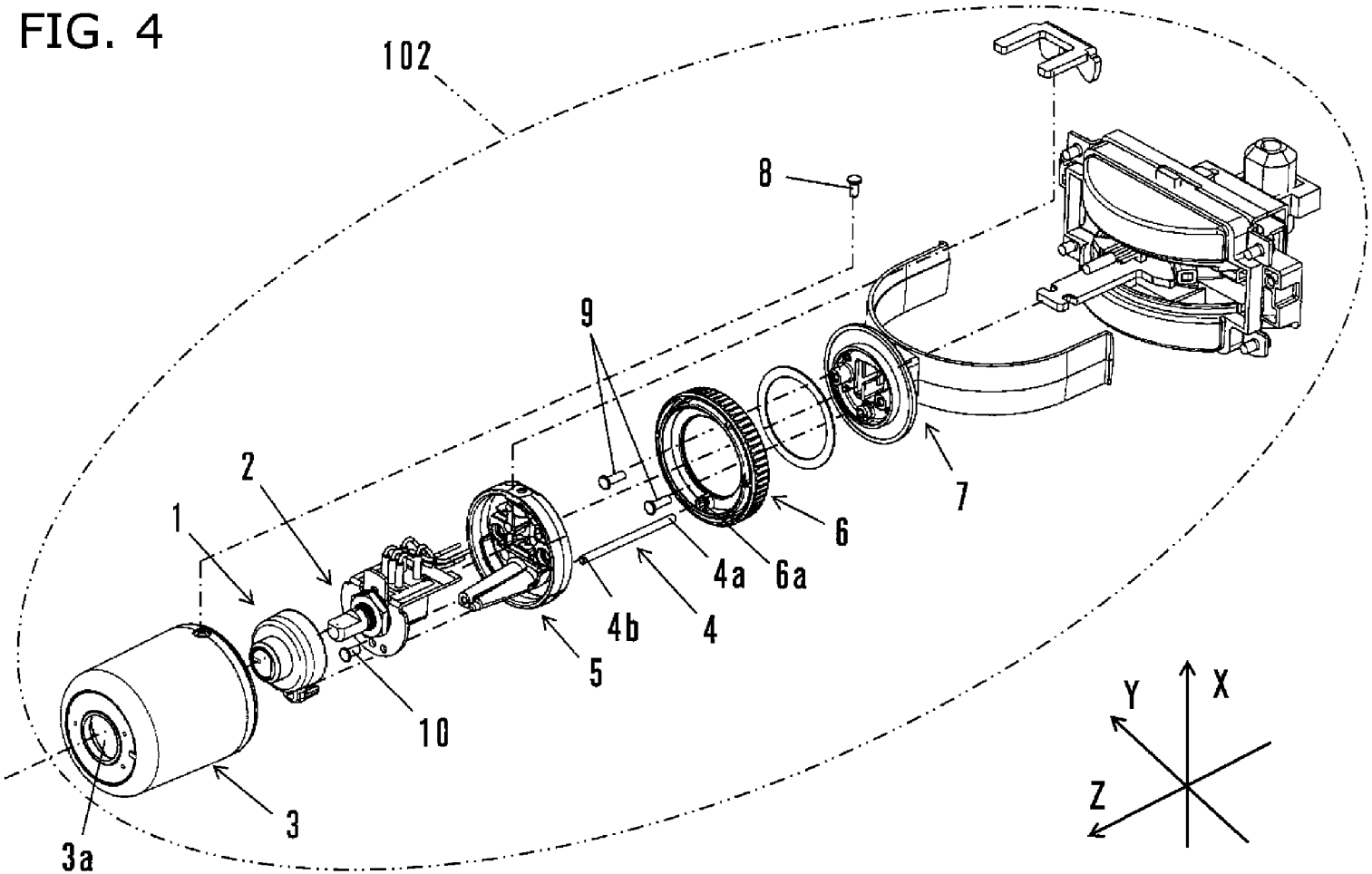
FIG. 4 is an exploded oblique view of the configuration of the iris control lever in FIG. 2.

As shown in FIGS. 3 and 4, the rotary operation type switch component 102*a* has a cap 1, a VR (vibration reduction) switch 2, the case 3 (cylinder), a shaft 4, a holder 5, the rotary control 6, a cover 7, and screws 8 to 10.

Cap 1

As shown in FIGS. 3 and 4, the cap 1 is enclosed in the case 3, which constitutes the outer profile of the rotary operation type switch component 102*a*, and is provided to the upper part in the space inside the case 3. Also, the cap 1 has a marking 1*a* that indicates the relative rotation position of the rotary control 6 with respect to the holder 5, at the portion exposed from an opening 3*a* formed in the top face of the case 3.

As shown in FIGS. 2 and 3, the marking 1*a* is provided to the exposed portion of the cap 1 disposed along the rotational axis of the rotary control 6, and rotates around the common rotational axis with the rotary control 6 in conjunction with the rotation of the rotary control 6. Therefore, the user can easily recognize the rotation position of the rotary control 6 by just looking at the position of this marking 1*a*. That is, providing the marking 1*a* allows the user to easily recognize how much further the rotary control 6 can be turned to the limit position in the directions of increasing and decreasing the black level. Thus, the user can adjust the black level more effectively.

VR Switch 2

As shown in FIGS. 3 and 4, the VR switch 2 is used to switch the preview screen output on and off, and is provided between the holder 5 and the cap 1 in the interior of the case 3.

Case 3

As shown in FIG. 4, the case 3 is a cylindrical member that is fixed with the screw 8 to the holder 5, and houses in its interior the cap 1, the VR switch 2, the shaft 4, and the holder 5. The case 3 has on its top face a substantially circular opening 3*a* for exposing to the outside a marking 1*a* formed on the cap 1.

Shaft 4

As shown in FIGS. 3 and 4, the shaft 4 is a rod-shaped member provided for transmitting rotational force imparted from the outside to the rotary control 6, and is provided in the interior of the case 3.

Figure 5:
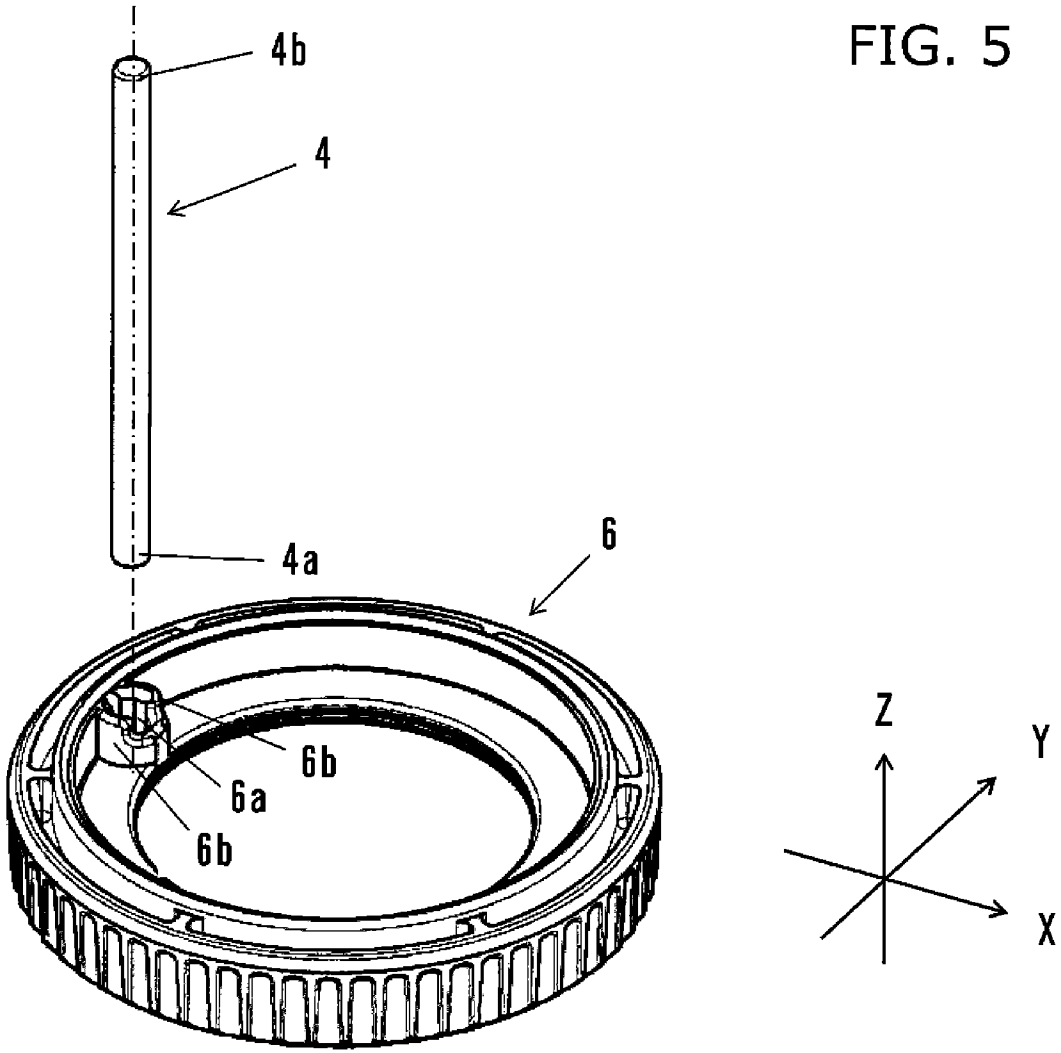
FIG. 5 is an oblique view of the configuration near the press-fitting portion that links the shaft and the rotary control included in the iris control lever in FIG. 2.
Figure 6:
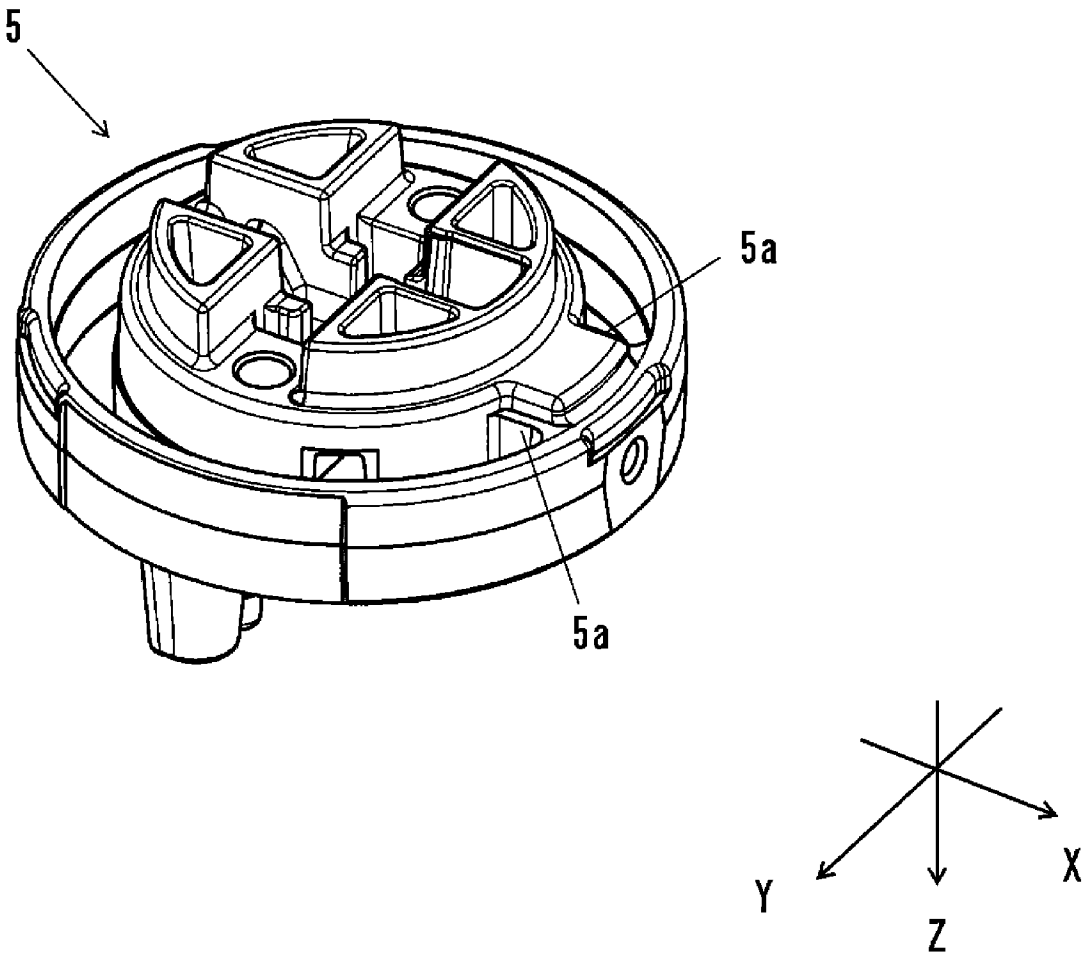
FIG. 6 is an oblique view of the configuration of the holder included in the iris control lever in FIG. 2.

One end 4*a* (first end) of the shaft 4 is fixed by press-fitting to a press-fitting portion (fixing portion) formed on part of the rotary control 6, as shown in FIGS. 4 and 5.

Figure 8:
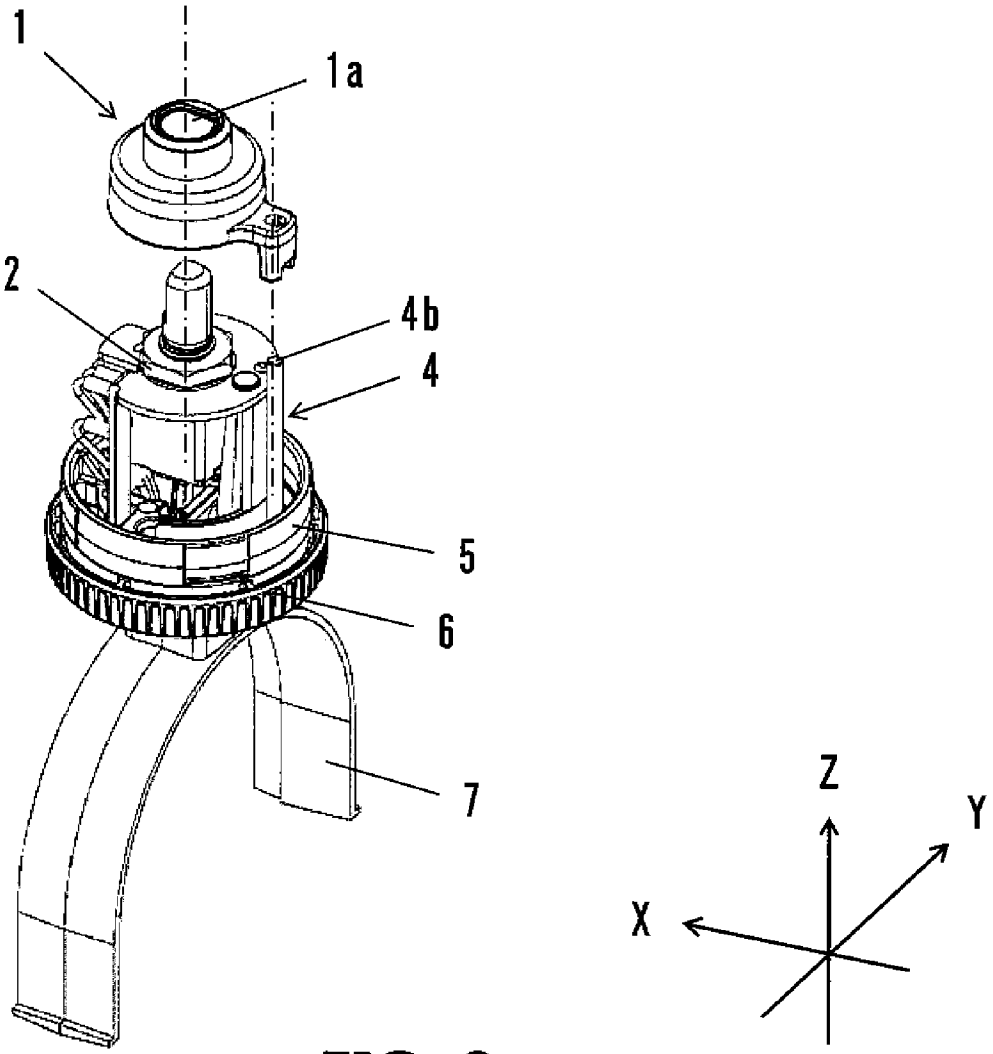
FIG. 8 is an oblique view of the state in the assembly process of the iris control lever in FIG. 2.

Furthermore, the other end 4*b* (second end) of the shaft 4 is connected to the cap 1 (see FIG. 8). Consequently, when the rotary control 6 is turned, the shaft 4 moves so that it revolves on the outer peripheral side of the holder 5, and the rotational force imparted from the outside to the rotary control 6 can be reliably transmitted through the cap 1 to the VR switch 2.

Holder 5

The holder 5 is fixed to the cover 7, and as shown in FIGS. 3 and 4, it is provided between the rotary control 6 and the VR switch 2 in the interior of the case 3. The VR switch 2 is fixed by the screw 10 to the upper part of the holder 5.

A stopper 5*a*, which restricts the limit position of the rotation range of the rotary control 6 by coming into contact with the outer wall part 6*b* on the rotary control 6 side (discussed in detail below), is provided on the rear face side (the −Z direction side shown in FIG. 4) of the holder 5.

The stopper 5*a* has a face disposed in a direction that intersects the rotational direction of the rotary control 6.

Rotary Control 6

As shown in FIG. 2, the rotary control 6 is an annular member having a plurality of bumps all the way around its outer peripheral face exposed on the outside, and can rotate relatively with respect to the case 3 (the holder 5) by grasping and turning the bumpy portion. That is, the user can grasp the outer peripheral portion of the rotary control 6 to transmit this rotational force through the shaft 4 to the VR switch 2 and thereby adjust the black level of the shoulder camera.

As shown in FIG. 5, the rotary control 6 has on its substantially annular inner peripheral portion a press-fitting portion (fixing portion) 6*a* into which the end 4*a* of the shaft 4 is press-fitted, and the outer wall part 6*b* that forms the outer peripheral face of the press-fitting portion 6*a*.

The press-fitting portion 6*a* has an inside diameter that is slightly smaller than the outside diameter of the shaft 4, and holds the shaft 4 in a state in which the end 4*a* of the shaft 4 is inserted.

The outer wall part 6*b* forms the outer peripheral face of a thick-walled portion provided so as to surround the press-fitting portion 6*a*, and is provided in a direction that intersects the rotational direction of the rotary control. The outer wall part 6*b* restricts the limit position of the rotation range of the rotary control 6 by coming into contact with the stopper 5*a* formed on part of the holder 5 when the rotary control 6 is turned.

Figure 7:
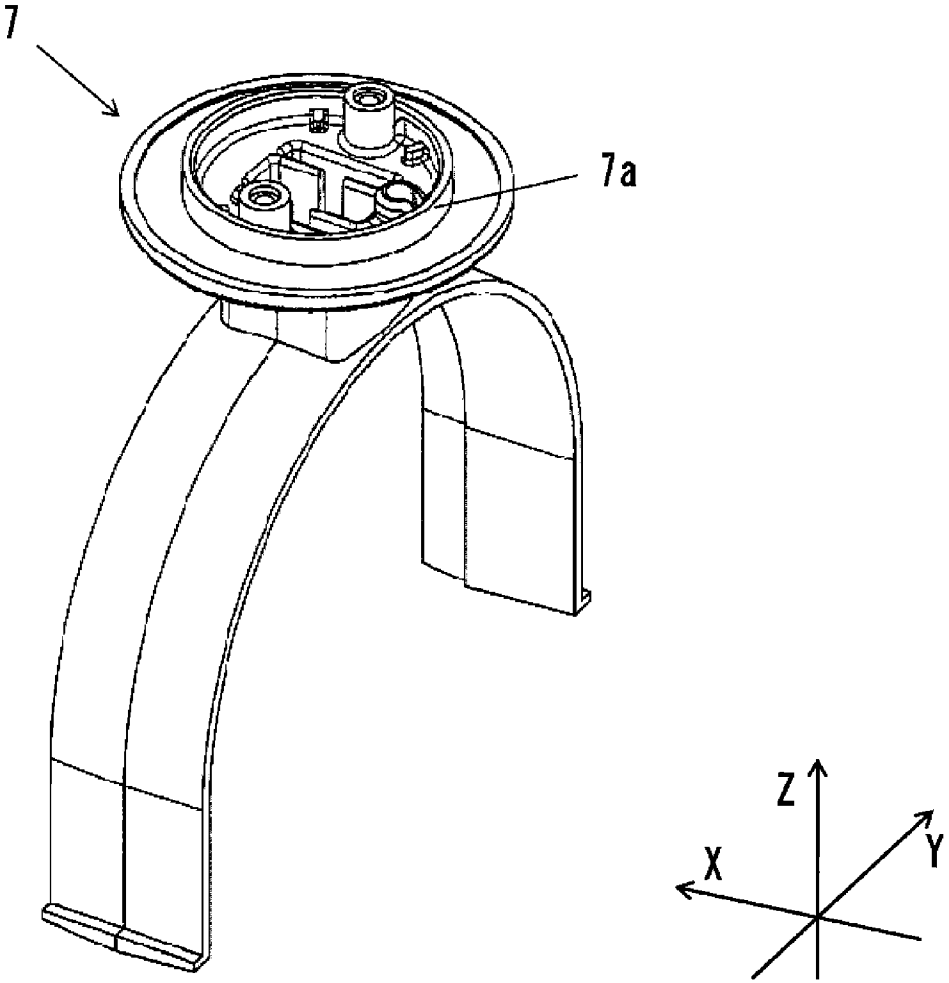
FIG. 7 is an oblique view of the configuration of the cover included in the iris control lever in FIG. 2.

The rotary control 6 is also able to rotate along a substantially annular guide portion 7*a* formed on the cover 7 shown in FIG. 7.

Cover 7

The cover 7 constitutes a base portion of the rotary operation type switch component 102*a*, and links the rotary operation type switch component 102*a* with the lever operation type switch component 102*b*. As shown in FIG. 7, the cover 7 has the substantially annular guide portion 7*a* on its upper face.

The guide portion 7*a* engages with the inner peripheral face of the rotary control 6 and guides the rotary control 6 in the rotational direction.

Furthermore, as shown in FIG. 8, the rotary control 6, the holder 5, the shaft 4, the VR switch 2, and the cap 1 are disposed in that order in the Z direction on the cover 7 to complete the assembly of the rotary operation type switch component 102*a*.

Rotation Range of Rotary Operation Type Switch Component 102*a*

Figure 9:
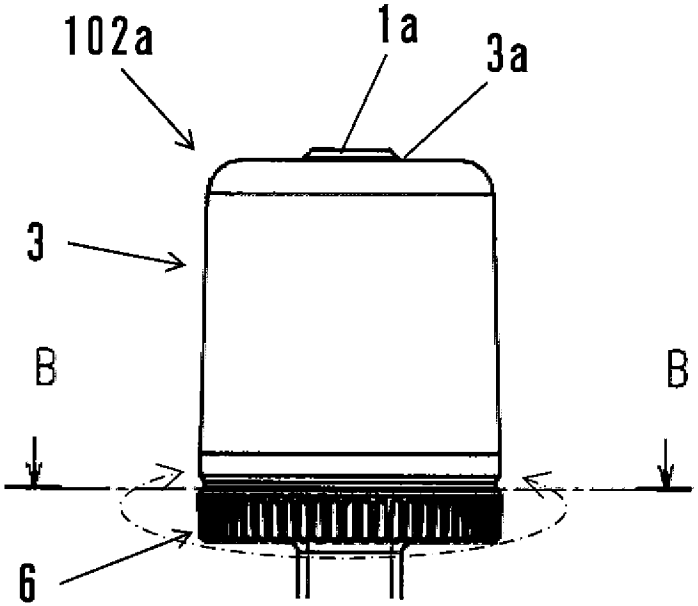
FIG. 9 is a side view of the configuration of the rotary operation type switch of the iris control lever in FIG. 2.
Figure 10:
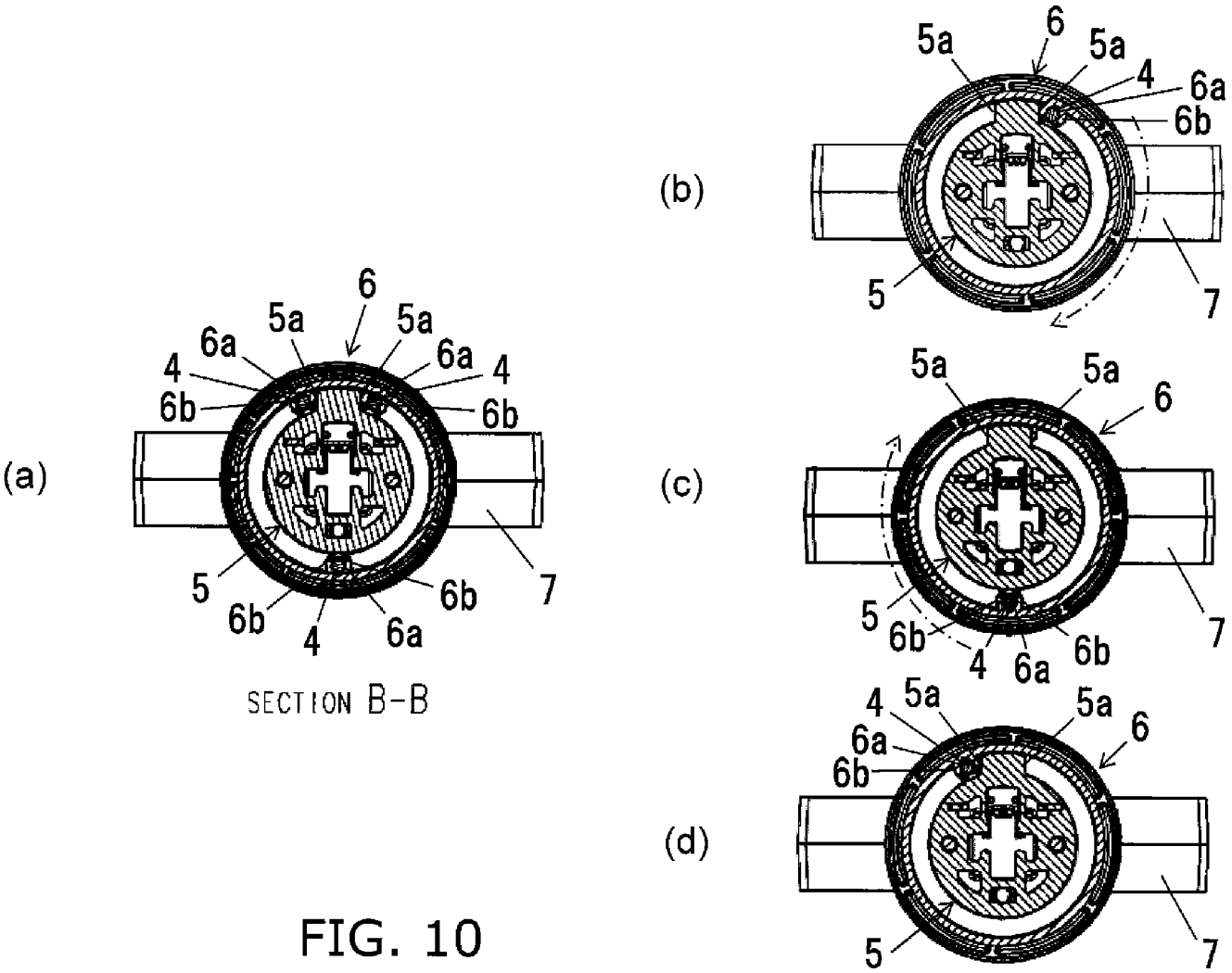
FIGS. 10*a* to 10*d* are cross sections along the B-B line of the rotary operation type switch in FIG. 9.

As shown in FIG. 9, the rotary operation type switch component 102*a* in this embodiment is such that when the user grasps and turns the outer peripheral part of the rotary control 6, the constituent members interfere with each other inside the case 3, which restricts the rotation range.

FIGS. 10*a* to 10*d* are cross sections along the B-B line of the rotary operation type switch component 102*a* shown in FIG. 9.

As shown in FIG. 10*a*, the rotary operation type switch component 102*a* restricts the range over which the rotary control 6 is able to rotate to a range between the two positions at which the outer wall part 6*b* that turns within the case 3 and the stopper 5*a* formed on part of the fixed holder 5 come into contact with each other.

Specifically, with the rotary operation type switch component 102*a*, as shown in FIG. 10*b*, one limit position in the range over which the rotary control 6 can rotate (the first limit position) is set as the upper-right position in the drawing, that is, the position at which the outer wall part 6*b* on the rotary control 6 side comes into contact with the side face of the stopper 5*a* on the right side in the drawing.

Then, when the rotary control 6 is turned from the first limit position shown in FIG. 10*b* in the clockwise direction in the drawing, the outer wall part 6*b* on the rotary control 6 side moves in the peripheral direction along the outer periphery of the holder 5 as shown in FIG. 10*c*. That is, FIG. 10*c* shows the middle position in the rotation range of the rotary control 6.

As the rotary control 6 is turned further in the clockwise direction in the drawing, it reaches the other limit position (the second limit position) in the range over which the rotary control 6 can rotate. That is, as shown in FIG. 10*d*, the second limit position of the rotary control 6 is set as the upper-left position in the drawing, that is, the position at which the outer wall part 6*b* on the rotary control 6 side comes into contact with the side face of the stopper 5*a* on the left side in the drawing.

With the rotary operation type switch component 102*a* in this embodiment, because of the above configuration, the range over which the rotary control 6 can rotate is restricted when the outer wall part 6*b* on the rotary control 6 side and the stopper 5*a* on the holder 5 side come into contact.

Consequently, the limit position of the rotation range is restricted by having the outer wall part 6*b*, which constitutes the outer peripheral face of the press-fitting portion 6*a* to which the end 4*a* of the shaft 4 is press-fitted, and part of the holder 5 (the stopper 5*a*) come into contact with each other. Therefore, the load that is produced upon each arrival at the two ends in the rotation range of the rotary control 6 can be borne by the outer wall part 6*b* that constitutes the outer peripheral face of the press-fitting portion 6*a*.

The outer wall part 6*b* here is a portion that constitutes the outer peripheral face of the press-fitting portion 6*a*, and is relatively stiff, so the problem of strength is solved. Furthermore, the shaft 4 itself can be prevented from bearing the load that is produced upon each arrival at the limit positions in the rotation range.

As a result, the problem of strength can be solved by a simple configuration that does not compromise aesthetics, and a rotary operation type switch component 102*a* that can be manufactured inexpensively can be obtained.

The various members that make up of the above-mentioned rotary operation type switch component 102*a* may be formed as resin molded articles, or some of them may be metal parts.

Consequently, those parts that have relatively complex shapes, such as the rotary control 6 with its outer wall part 6*b*, for example, can be formed as molded articles using a resin with high stiffness, allowing a rotary operation type switch component 102*a* to be formed that solves the problem of strength inexpensively.

Other Embodiments

An embodiment of this disclosure was described above, but this disclosure is not limited to or by the above embodiment, and various modifications are possible without departing from the gist of the disclosure.

(A)

In the above embodiment, an example was given in which the end 4*a* of the shaft 4 was fixed to the press-fitting portion 6*a* of the rotary control 6, but the present disclosure is not limited to this.

How the end of the shaft is fixed is not limited to press-fitting, and may instead be, for example, to fix the end of the shaft to a member on the rotating side by latching, adhesive bonding, or some other such fixing method.

Here again the same effect will be obtained as with the configuration in the above embodiment.

(B)

In the above embodiment, an example was given in which the rotary operation type switch pertaining to this disclosure was installed in the remote operation panel 100 for use in a shoulder camera, but the present disclosure is not limited to this.

That is, this rotary operation type switch may be used in a shoulder camera or in any of various other kinds of device besides a camera.

INDUSTRIAL APPLICABILITY

The effect of the rotary operation type switch of this disclosure is that an inexpensive rotary operation type switch can be provided without compromising aesthetics, and therefore this rotary operation type switch can be broadly applied, not just to a panel used for adjusting image quality in a camera, but also as a rotary operation type switch installed in various other kinds of device.

The invention claimed is:

1. A rotary operation type switch, comprising:

a holder provided as a stationary-side member;

a rotary control that rotates relative to the holder in response to a rotational force applied thereto; and a shaft arranged to transmit the rotational force applied to the rotary control, wherein the rotary control includes a fixing portion into which a first end of the shaft is inserted, the fixing portion includes an outer wall part arranged along a direction that is perpendicular to the rotational direction of the rotary control;

the holder includes a stopper arranged to contact the outer wall part and restrict a limit position of a rotation range of the rotary control when the rotary control and the shaft are rotated relative to the holder, and the shaft rotates around a rotational axis of the rotary control when the rotational force is applied to the rotary control.

2. The rotary operation type switch according to claim 1, further comprising a cylindrical part arranged to be adjacent to the holder and to envelop the holder and the shaft, the cylindrical part arranged to be immovable in the rotational direction of the rotary control and the shaft.

3. The rotary operation type switch according to claim 1, wherein a top face of the cylindrical part includes an opening, and said rotary operation type switch further comprises a marking that is exposed from the opening and indicates the rotational position of the rotary control with respect to the holder.

4. The rotary operation type switch according to claim 1, wherein the shaft is provided along the rotational axis direction of the rotary control, and when the rotational force is applied to the rotary control, the shaft rotates around the rotational axis nearer to a circumference of the holder in relation to the rotational axis, in a state in which its first end has been inserted into the fixing portion.

5. The rotary operation type switch according to claim 1, wherein the outer wall part includes a thick-walled portion provided so as to surround the fixing portion.

6. The rotary operation type switch according to claim 5, wherein the thick-walled portion includes an outer peripheral face, and the stopper is arranged to contact a part of the outer peripheral face.

7. The rotary operation type switch according to claim 1, wherein the shaft is disposed near a periphery of the rotary control.

* * * * *